United States Patent [19]

Grilliot et al.

[11] Patent Number: 4,709,421

[45] **Date of Patent: * Dec. 1, 1987**

[54] FIREFIGHTER'S COAT

[76] Inventors: William L. Grilliot; Mary I. Grilliot, both of 1986 Home Ave., Dayton, Ohio 45417

[ * ] Notice: The portion of the term of this patent subsequent to Dec. 9, 2003 has been disclaimed.

[21] Appl. No.: 936,620

[22] Filed: Dec. 1, 1986

Related U.S. Application Data

[63] Continuation of Ser. No. 733,195, May 13, 1985, Pat. No. 4,627,112.

[51] Int. Cl.[4] ..... A41D 1/02; A41D 13/00

[52] U.S. Cl. ..... 2/81; 2/93

[58] Field of Search ..... 2/81, 82, 93, 94, 46

[56] References Cited

U.S. PATENT DOCUMENTS

| | | | |
|---|---|---|---|
| 69,180 | 9/1867 | Cohen | 2/93 |
| 2,437,223 | 3/1948 | Dutrow | 2/94 |
| 2,627,072 | 2/1953 | Frommelt et al. | 2/81 X |
| 3,708,799 | 1/1973 | Smithdeal | 2/46 |

*Primary Examiner*—H. Hampton Hunter

[57] ABSTRACT

A firefighter's coat of the jacket type in which the jacket has a neck portion and a front portion and a rear portion and in which the front portion has a length which extends downwardly from the neck portion to a position immediately above the firefighter's legs and in which the rear portion is substantially longer than the front portion. The jacket is made of flame resistant, water resistant, and heat resistant material. The jacket also has a built-in vapor barrier. The jacket thus provides good protection for the firefighter, while also permitting good ventilation, and while also permitting freedom of leg movement for walking, crawling, and climbing, and the like.

3 Claims, 4 Drawing Figures

FIG-1
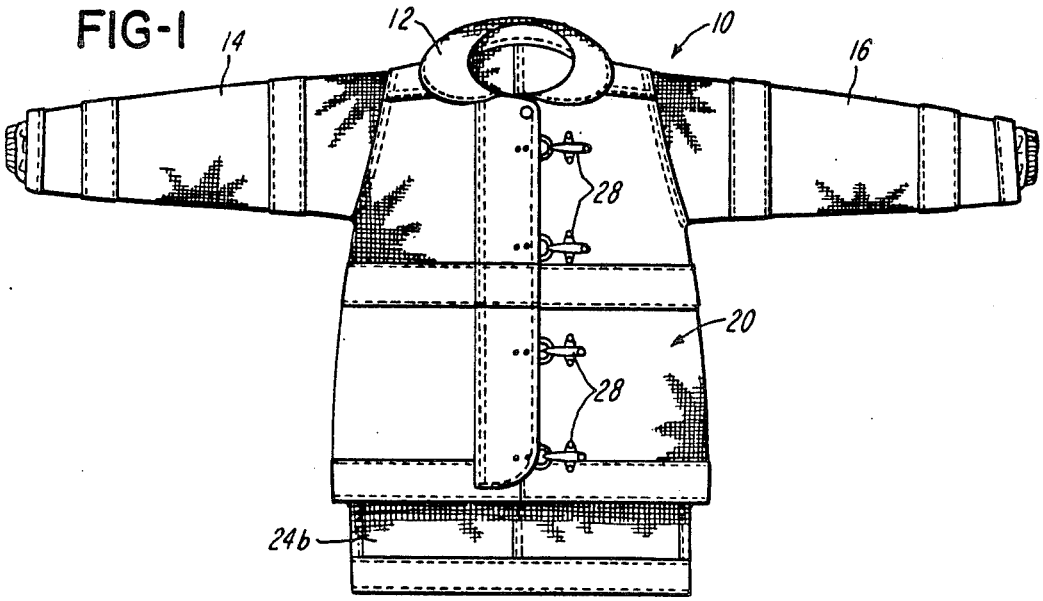
FIG-2
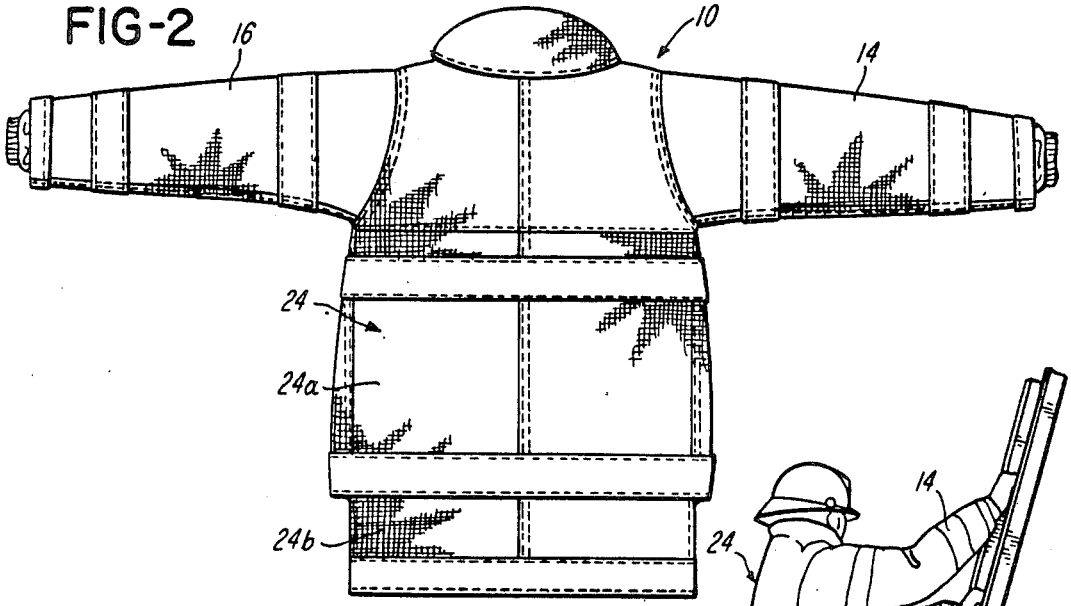
FIG-3
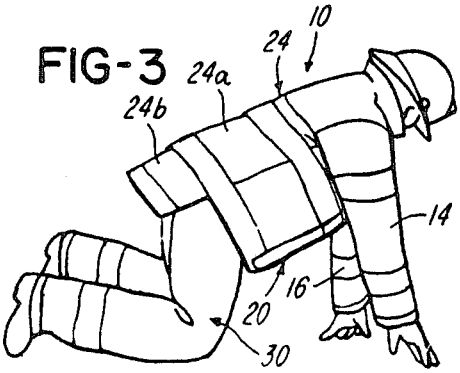
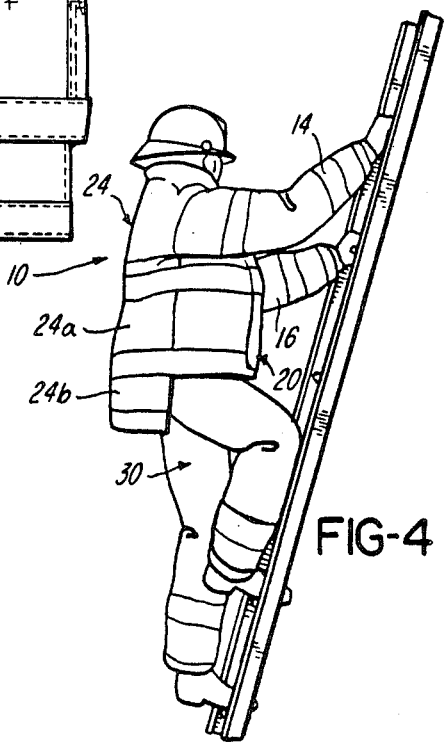
FIG-4

FIREFIGHTER'S COAT

RELATED APPLICATION

This application is a continuation of application Ser. No. 733,195, filed May 13, 1985, now U.S. Pat. No. 4,627,112.

BACKGROUND OF THE INVENTION

During the fighting of a fire, a firefighter works in a very hostile environment. Many firefighters lose their lives while fighting fires. Most of the deaths of firefighters while fighting fires are the result of stress, heart attacks, strokes, and the like. Of course, a firefighter must be protected from the environment within which the firefighter works. However, in an attempt to provide adequate protection, the coats of firefighters have been too heavy and too bulky. Furthermore, in an attempt to provide adequate protection, the coats worn by firefighters have not provided adequate ventilation.

It is an object of this invention to provide a firefighter's coat which provides the same quality or better protection against the environment than a conventional coat. It is also an object of this invention to provide such a coat which has less weight, permitting greater ease of movement of the firefighter, and a coat which provides greater ventilation to the firefighter, than the conventional coat of a firefighter. Thus, the stress involved in the work of the firefighter is significantly reduced.

Another object of this invention is to provide such a firefighter's coat which can be constructed at lower costs than a firefighter's conventional coat.

SUMMARY OF THE INVENTION

A firefighter's coat of this invention comprises a jacket type of garment which has a neck portion and which has a front portion which extends downwardly from the neck portion to a position adjacent the upper part of the legs of the firefighter. The coat has a rear portion which is significantly longer than the front portion of the coat. Thus, the firefighter has freedom of leg movement due to the fact that the front portion of the coat does not engage the legs of the firefighter. Freedom of leg movement is of value in climbing a ladder or in crawling, as well as in normal walking. Also, due to the fact that the front portion of the coat is open above the legs of the firefighter, greater ventilation is permitted than in a coat which has a front portion which covers a part of the firefighter's legs. The rear portion of the coat of this invention provides protection to the rear torso of the firefighter including protection of the lower rear torso of the firefighter. Thus, the firefighter is protected when the firefighter bends forwardly and when the firefighter crawls or walks in a stooped posture.

BRIEF DESCRIPTION OF THE VIEWS OF THE DRAWING

FIG. 1 is a front elevational view of a firefighter's coat of this invention.

FIG. 2 is a rear elevational view of the firefighter's coat.

FIG. 3 is a side elevational view, drawn on a smaller scale than FIGS. 1 and 2, illustrating a firefighter wearing the coat of this invention while crawling.

FIG. 4 is a side elevational view, drawn on substantially the same scale as FIG. 3, illustrating a firefighter wearing the coat of this invention while climbing a ladder.

DETAILED DESCRIPTION OF THE INVENTION

A firefighter's coat of this invention comprises a jacket 10 which includes a neck band 12, sleeves 14 and 16, a two-part front portion 20, and a rear portion 24. Fastener devices 28 are shown on the front portion 20 of the jacket 10 for attaching together the two parts thereof. The jacket 10 is constructed in accordance with the physical size and proportions of a given firefighter. Thus the height and other physical features of the firefighter are considered in construction of the firefighter's jacket 10. The front portion 20 of the jacket 10 is constructed to have a length which extends from the neck band 12 to a position adjacent the upper portion of the legs of the firefighter, thus covering the entire front portion of the firefighter's torso.

The rear portion 24 of the jacket 10 has a main part **24*a* which has substantially the same length as the front portion of the jacket 10. The rear portion 24 of the jacket 10 also has a tail part 24*b* which extends downwardly substantially below the main portion 24*a***.

Preferably, the front portion 20 of the jacket 10 extends downwardly from the neck portion 12 to a position about nine inches below the waist of the firefighter. Thus, the lower edge of the front portion 20 is at the upper part of the legs or at the crotch at the upper part of the legs of the firefighter. Preferably, the tail part **24*b* extends about six inches below the main part 24*a*. Thus, preferably the tail part 24*b*** extends to a position about fifteen inches below the waist of the firefighter and covers the lower rear torso of the firefighter.

The jacket 10 is constructed of material which is flame resistant, heat resistant, water resistant and which has a built-in vapor barrier.

The firefighter wears conventional bunker pants 30, which protect the firefighter's legs. The jacket 10 of this invention protects the torso of the firefighter, while also protecting the arms of the firefighter. Due to the fact that the front portion 20 of the jacket 10 extends to a position immediately above the legs, the firefighter has freedom of leg movement, for walking and for crawling, as illustrated in FIG. 3, and for climbing a ladder, as illustrated in FIG. 4.

The tail portion **24*b* of the jacket 10 provides protection for the lower rear portion or lower torso portion of the firefighter as the firefighter bends over in a stooped posture and while the firefighter is crawling, as illustrated in FIG. 3. If the jacket 10 did not have the tail portion 24*b***, the rear lower torso of the firefighter would be exposed when the firefighter bends over or crawls.

Thus, the firefighter's coat of this invention provides substantially the same protection as a conventional coat worn by a firefighter. However, the firefighter's coat of this invention permits greater freedom and ease of movement of the firefighter than a conventional coat worn by a firefighter. The coat of this invention consists of less material than a firefighter's conventional coat. Thus, the coat of this invention is lighter in weight than a firefighter's conventional coat. Also, the firefighter's coat of this invention permits better ventilation to the firefighter than a conventional coat, due to the fact that the front portion 20 extends only from the neck portion to a position immediately above the legs of the firefighter.

Although the preferred embodiment of the firefighter's coat of this invention has been described, it will be understood that within the purview of this invention various changes may be made in the form, details, proportion and arrangement of parts, the combination thereof, and the manner of use, which generally stated consist in a firefighter's coat within the scope of the appended claims.

The invention having thus been described, the following is claimed:

1. An improved firefighter's coat adapted for use with firefighter's pants extending downwardly from the waist of the firefighter to provide for full protection of the firefighter while also providing for less weight and improved freedom of movement and ventilation to reduce stress, comprising a jacket constructed of heat, flame and water resistant materials, the jacket including full length sleeve portions connected by a neck portion, a front portion and a rear portion, the front and rear portions being joined by opposing side portions, the front portion and side portion extending downwardly from the neck portion and having a lower edge disposed below the firefighter's waist and adjacent the upper part of the firefighter's legs, the rear portion extending between the side portions and extending downwardly from the neck portion and having a lower edge disposed significantly below the lower edge of the front portion and side portions and the lower edge being substantially above the knees of the firefighter to form a limited tail extension covering the lower rear part of the torso of the firefighter, the front portion and side portions thus being significantly shorter than the rear portion to provide the firefighter's legs with freedom of movement while crawling and climbing, in addition to improved ventilation under the front portion and side portions, the limited tail extension of the rear portion of the jacket protecting the lower rear part of the torso of the firefighter especially during forward bending or crawling, and the combined portions of the jacket also providing for reducing the total weight of the firefighter's coat.

2. An improved firefighter's coat adapted for use with firefighter's pants extending downwardly from the waist of the firefighter to provide for full protection of the firefighter while also providing for less weight and improved freedom of movement and ventilation to reduce stress, comprising a jacket constructed of heat, flame and water resistant materials, the jacket including full length sleeve portions connected by a neck portion, a front portion and a rear portion, the front portion extending downwardly from the neck portion and having a lower edge disposed below the firefighter's waist and adjacent the upper part of the firefighter's legs, the rear portion extending downwardly from the neck portion and having a lower edge disposed about six inches below the lower edge of the front portion and substantially above the knees of the firefighter to form a limited tail extension covering the lower rear part of the torso of the firefighter, the jacket also including side portions, the limited tail extension also extending between the side portions, the limited tail extension also including a horizontal band portion which extends substantially between the side portions, the front portion thus being significantly shorter than the rear portion to provide the firefighter's legs with freedom of movement while crawling and climbing, in addition to improved ventilation under the front portion, the limited tail extension of the rear portion of the jacket protecting the lower rear part of the torso of the firefighter especially during forward bending or crawling, and the combined portions of the jacket also providing for reducing the total weight of the firefighter's coat.

3. An improved firefighter's coat adapted for use with firefighter's pants extending downwardly from the waist of the firefighter to provide for full protection of the firefighter while also providing for less weight and improved freedom of movement and ventilation to reduce stress, comprising a jacket constructed of heat, flame and water resistant materials, the jacket including full length sleeve portions connected by a neck portion, a front portion and a rear portion, the front portion extending downwardly from the neck portion and having a lower edge disposed about nine inches below the firefighter's waist and adjacent the upper part of the firefighter's legs, the rear portion extending downwardly from the neck portion and having a lower edge disposed about six inches below the lower edge of the front portion and substantially above the knees of the firefighter to form a limited tail extension covering the lower rear part of the torso of the firefighter, the lower edge including a band portion, the front portion thus being significantly shorter than the rear portion to provide the firefighter's legs with freedom of movement while crawling and climbing, in addition to improved ventilation under the front portion, the limited tail extension of the rear portion of the jacket protecting the lower rear part of the torso of the firefighter especially during forward bending or crawling, and the combined portions of the jacket also providing for reducing the total weight of the firefighter's coat.

* * * * *

UNITED STATES PATENT AND TRADEMARK OFFICE

CERTIFICATE OF CORRECTION

PATENT NO. : 4,709,421
DATED : December 1, 1987
INVENTOR(S) : William L. Grilliot and May I. Grilliot It is certified that error appears in the above-identified patent and that said Letters Patent is hereby corrected as shown below:

Title page,
Item [*], the asterisk should read as follows:

The portion of the term of this patent subsequent to the expiration date of Patent No. 4,627,112 has been disclaimed.

Signed and Sealed this

Fourteenth Day of May, 2002

*Attest:*

*Attesting Officer*

JAMES E. ROGAN
*Director of the United States Patent and Trademark Office*